US008235121B2

(12) United States Patent
Williams

(10) Patent No.: US 8,235,121 B2
(45) Date of Patent: Aug. 7, 2012

(54) SUBSEA CONTROL JUMPER MODULE

(75) Inventor: Alfred Moore Williams, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 198 days.

(21) Appl. No.: 12/639,713

(22) Filed: Dec. 16, 2009

(65) Prior Publication Data

US 2011/0139459 A1 Jun. 16, 2011

(51) Int. Cl.
*E21B 19/00* (2006.01)
*F16L 39/00* (2006.01)

(52) U.S. Cl. ..... 166/347; 166/338; 166/344; 166/351; 166/378; 285/124.1

(58) Field of Classification Search ..... 166/347, 166/338, 339, 341–344, 351, 242.1, 368, 166/250.01, 373, 378–381, 386; 285/123.1, 285/124.1, 920
See application file for complete search history.

(56) References Cited

U.S. PATENT DOCUMENTS 3,820,600 A * 6/1974 Baugh ..... 66/338
4,075,862 A * 2/1978 Ames ..... 405/169
4,489,959 A * 12/1984 Satterwhite ..... 285/18
5,320,175 A * 6/1994 Ritter et al. ..... 166/339
5,417,459 A * 5/1995 Gray et al. ..... 285/26
5,456,313 A * 10/1995 Hopper et al. ..... 166/97.1
5,458,440 A * 10/1995 Van Helvoirt ..... 405/169
6,102,124 A * 8/2000 Skeels et al. ..... 166/347
6,161,618 A * 12/2000 Parks et al. ..... 166/351
6,167,831 B1 * 1/2001 Watt et al. ..... 114/322
6,223,675 B1 * 5/2001 Watt et al. ..... 114/312
6,481,504 B1 * 11/2002 Gatherar ..... 166/344
6,484,806 B2 * 11/2002 Childers et al. ..... 166/351
6,588,980 B2 * 7/2003 Worman et al. ..... 405/158
6,612,369 B1 * 9/2003 Rocha et al. ..... 166/363
6,702,025 B2 * 3/2004 Meaders ..... 166/335
6,742,594 B2 * 6/2004 Langford et al. ..... 166/350
6,793,019 B2 * 9/2004 Rodgers et al. ..... 166/344
6,796,261 B2 * 9/2004 Colyer ..... 114/258
6,880,640 B2 * 4/2005 Barratt et al. ..... 166/346
6,902,199 B2 * 6/2005 Colyer et al. ..... 285/29
6,907,932 B2 * 6/2005 Reimert ..... 166/341
6,988,554 B2 * 1/2006 Bodine et al. ..... 166/363
7,032,673 B2 * 4/2006 Dezen et al. ..... 166/341
7,044,228 B2 * 5/2006 Langford et al. ..... 166/350
7,063,485 B2 * 6/2006 Jordan et al. ..... 405/224.4
7,172,447 B2 * 2/2007 Allensworth et al. ..... 439/271
7,219,740 B2 * 5/2007 Saucier ..... 166/366
7,261,162 B2 * 8/2007 Deans et al. ..... 166/336
7,296,629 B2 * 11/2007 Bartlett ..... 166/348
7,318,479 B2 * 1/2008 Williams ..... 166/341
7,467,662 B2 * 12/2008 Smith ..... 166/343
7,565,931 B2 * 7/2009 Saucier ..... 166/344
7,565,932 B2 * 7/2009 Lawson ..... 166/344
7,677,623 B2 * 3/2010 Bath et al. ..... 294/81.5
7,717,646 B2 * 5/2010 Webster ..... 405/168.3
7,749,008 B2 * 7/2010 Klassen et al. ..... 439/201
7,802,624 B2 * 9/2010 Barratt ..... 166/338
7,857,604 B2 * 12/2010 Shaw et al. ..... 417/422

(Continued)

*Primary Examiner* — Matthew Buck
(74) *Attorney, Agent, or Firm* — Baker Botts L.L.P.

(57) ABSTRACT

A jumper including an upstream connector configured to communicate with an umbilical, and a downstream connector configured to communicate with an end device. The jumper also includes a conduit having a first end attached to the upstream connector and a second end attached to the downstream connector, a plurality of valves, and a programmable processor.

11 Claims, 3 Drawing Sheets

U.S. PATENT DOCUMENTS

| | | | | |
|---|---|---|---|---|
| 7,866,398 | B2 * | 1/2011 | Barratt et al. | 166/341 |
| 2001/0034153 | A1 * | 10/2001 | McIntosh et al. | 439/364 |
| 2005/0039923 | A1 * | 2/2005 | Howe et al. | 166/368 |
| 2007/0227740 | A1 * | 10/2007 | Fontenette et al. | 166/344 |
| 2008/0143100 | A1 * | 6/2008 | Webster | 285/18 |
| 2009/0038805 | A1 * | 2/2009 | Parks et al. | 166/341 |
| 2010/0059229 | A1 * | 3/2010 | Smith et al. | 166/346 |

* cited by examiner

SUBSEA CONTROL JUMPER MODULE

FIELD OF THE INVENTION

The present invention relates generally to subsea well systems, such as subsea trees and control modules, and, more particularly, to subsea jumpers.

BACKGROUND OF THE INVENTION

Jumpers may be used in subsea applications to connect a production outlet of a Christmas tree to another subsea component, such as a manifold, some distance away, such as from about 50 yards to about several miles. Conventional jumpers typically employ horizontal connections, i.e., the connectors and mating sockets are designed to mate horizontally. Some newer designs use vertical connections, as set forth in U.S. Pat. No. 7,318,479.

Conventionally, jumpers merely bridge the gap across a distance between subsea end devices, without performing any additional function. Frequently, jumpers are used in conjunction with a subsea control module capable of performing the desired functions. The subsea control module may include electronics, hydraulic valves, subsea electronics modules, and/or monitoring devices. The subsea control module is generally dispatched to perform the desired functions, even if some functions available in the subsea control module are not needed. The use of a subsea control module and a jumper results in unnecessary complexity in some instances. Additionally, the retrieval of the heavy subsea control module may be difficult in many instances.

By combining the subsea control module and the jumper a new capability exist that provides for the functionality and the connection of the two end devices.

SUMMARY

The present invention relates generally to subsea well systems, such as subsea trees and control modules, and, more particularly, to subsea jumpers.

One embodiment of the present disclosure provides a jumper that includes an upstream connector configured to communicate with an umbilical, a downstream connector configured to communicate with an end device, a conduit having a first end attached to the upstream connector and a second end attached to the downstream connector, a plurality of valves, and a programmable processor.

The features and advantages of the present invention will be readily apparent to those skilled in the art. While those skilled in the art may make numerous changes, such changes are within the spirit of the invention.

BRIEF DESCRIPTION OF THE DRAWINGS

A complete understanding of the present disclosure and advantages thereof may be acquired by referring to the following description taken in conjunction with the accompanying drawings, wherein.

Figure 1:
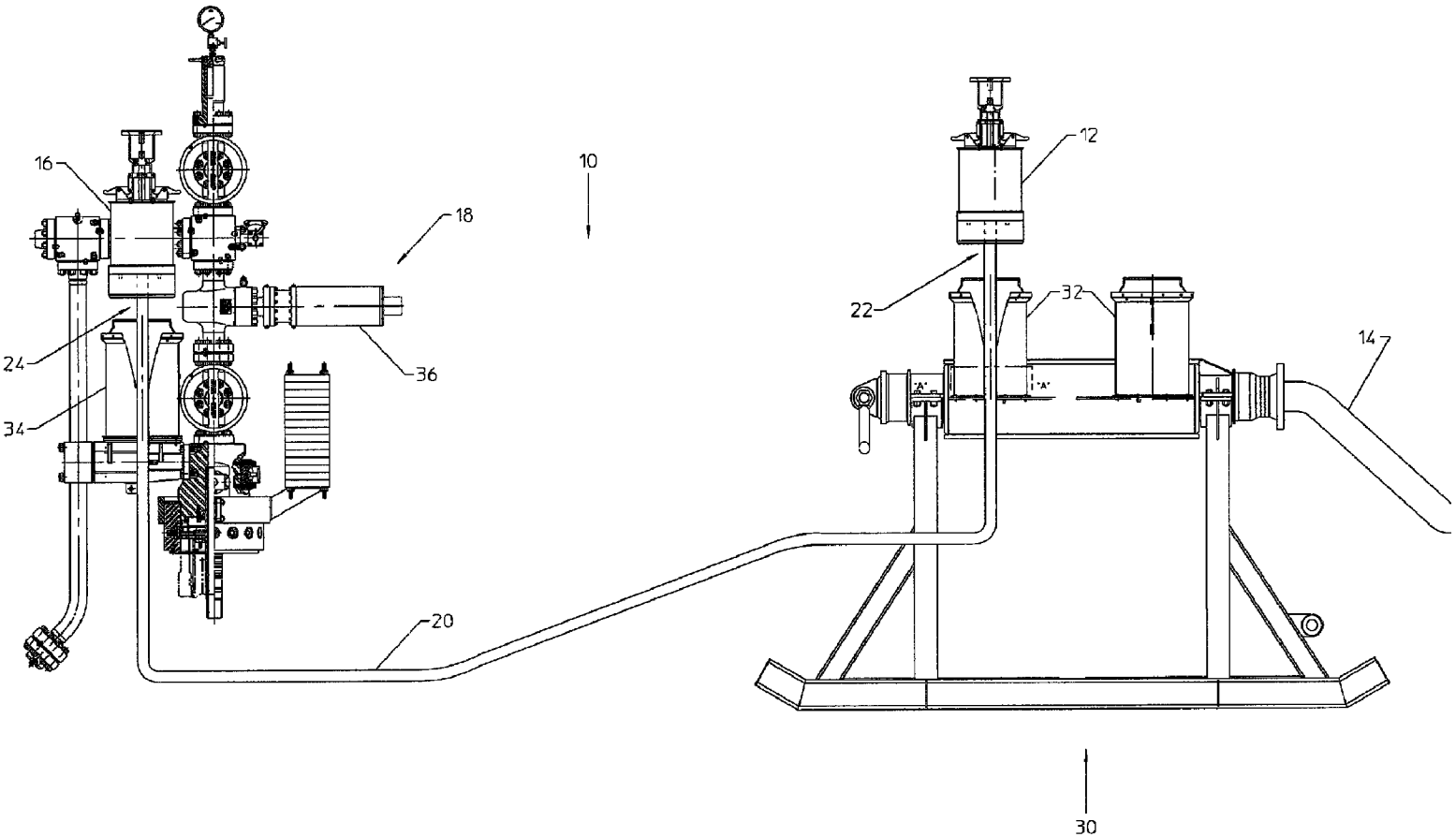
FIG. 1 illustrates a side view of jumper in accordance with various exemplary embodiments of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the present invention to the particular forms disclosed, but, on the contrary, the present intention is to cover all modifications, equivalents, and/or alternatives that fall within the spirit and scope of the present invention as defined by the appended claims.

DETAILED DESCRIPTION

Illustrative embodiments of the present invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The details of various illustrative embodiments of the present invention will now be, described with reference to the figures. Turning to FIG. 1, jumper 10 in accordance with various illustrative embodiments is shown. Jumper 10 may have upstream connector 12, downstream connector 16, and conduit 20 therebetween, along with programmable processor 28 (shown in FIG. 2) and valves 26 (shown in FIG. 2). Conduit 20 may have upstream end 22 and downstream end 24, and may attach to upstream connector 12 at upstream end 22, and to downstream connector 16 at downstream end 24 via Remotely Operated Vehicle ("ROV") or diver energized mechanical connectors that may include hydraulic and electric couplings. Conduit 20 may have any of a number of configurations useful for subsea operations. For example, conduit 20 may have a plurality of fluid and/or electrical conduits for connecting with mating conduits of end device 18 and/or umbilical termination mudline assembly 30, as by stabbing one into the other. Conduit 20 may include a hydraulic and electric bundle, or conduit 20 may be an actual tubular member surrounding a collection of smaller conduits and electrical cables. In some embodiments, conduit 20 may include steel tubings, hose lines, electrical wiring, compensation line, high-pressure hydraulic lines, low-pressure hydraulic lines, chemical lines, and/or fiber optic lines. In other embodiments, conduit 20 may be a super duplex tube, available from Sanvik of Sweden. Variations to conduit 20 to include a number of different configurations useful for jumper applications would be apparent to one having ordinary skill in the art. Ends 22 and 24 of conduit 20 and/or connectors 12 and 16 may be manipulated by one or more remotely operated vehicles (ROVs), arms or other parts for manipulation in a subsea environment.

Figure 3:
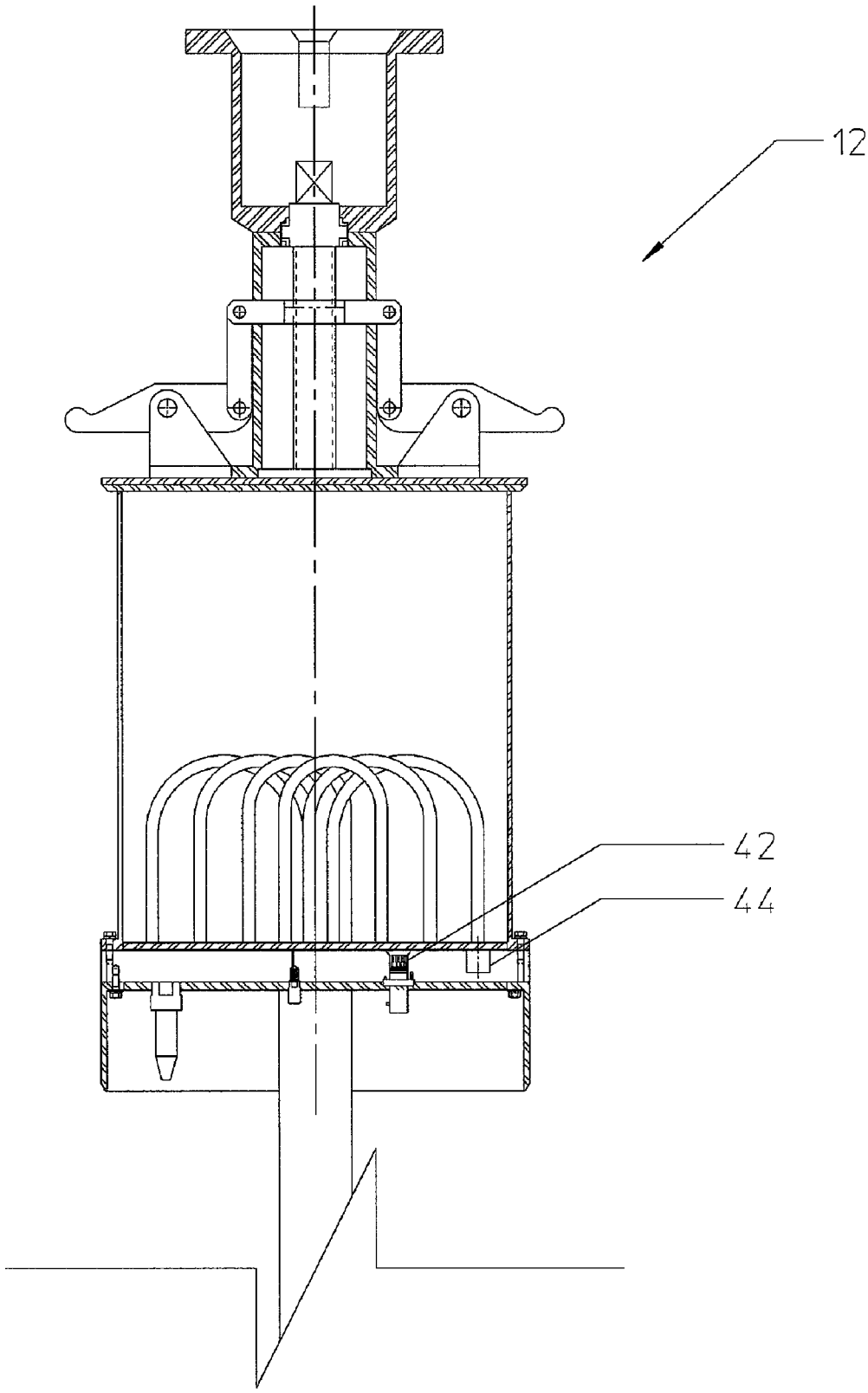
FIG. 3 illustrates a cross-sectional view of a downstream connector of a jumper in accordance with various exemplary embodiments of the present invention.

Upstream connector 12 may be configured to communicate with umbilical 14, to allow hydraulic supplies, electrical power and/or communications signals (either electric or fiber based) to be transmitted to upstream connector 12. Upstream connector 12 may include one or more of electrical connector 42 and hydraulic coupling 44, as shown in FIG. 3. Electrical connector 42 and hydraulic couplings 44 may provide interfaces for hydraulic supplies, electrical power and/or communications signals. In some embodiments, umbilical termination mudline assembly 30 may provide an interface between umbilical 14 and upstream connector 12. As illustrated in FIG. 1, umbilical termination mudline assembly 30 may have multiple mating sockets 32, allowing multiple jumpers to communicate with umbilical 14. Alternatively, umbilical termination mudline assembly 30 may have a single mating socket or may be replaced by any of a number of alternate interfaces between upstream connector 12 and umbilical 14, so long as upstream connector 12 has the ability to communicate with umbilical 14. In some embodiments, jumper 10 may have a number of features, including, but not limited to an electric power supply, a modem, hydraulic functions, and hydraulic filters. In certain embodiments, these features may be associated with upstream connector 12 and mating socket 34.

Programmable processor 28 may be associated with upstream connector 12, downstream connector 16, or both. In certain applications, programmable processor 28 may be included in upstream connector 12 to allow the size of downstream connector 16 to be reduced. Referring now to the illustrative embodiment of FIG. 2, programmable processor 28 may be contained within upstream connector 12. Programmable processor 28 may be a microprocessor (e.g., Motorola, Intel, etc.) configured to process and/or control various functions. For example, programmable processor 28 may be programmed to communicate with remote devices such as sensors, including but not limited to those that measure flow, pressure, temperature, position, corrosion, chemical flow rate, vibration, etc., or any other device that communicates with the microprocessor using an electrical signal incorporating a higher level software language and that provides data to the processor to be monitored or acted upon. Additionally, programmable processor 28 may be programmed to operate hydraulic functions such as tree and manifold valves, chokes, mechanical lock/unlock, latch/unlatch functions, or any other operation requiring hydraulic fluid at pressure to perform work on any of a number of end devices 18 and be delivered through umbilical 14. Further, programmable processor 28 may be programmed to monitor and/or interpret signals from remote sensors such as a current level, 4-20 ma, or in the form of a digital signal such as RS-422, RS-485, CanBus, FieldBus, etc. Programmable processor 28 may monitor data from the sensors and act upon the data issuing commands or controlling hydraulic functions. Programmable processor 28 may send signals to valves 26 via conduit 20.

Valves 26 may be associated with upstream connector 12, downstream connector 16, or both. Referring now to the illustrative embodiment of FIG. 3, valves 26 may be contained within downstream connector 16. Valves 26 may be electrically actuated direct control valves (DCV) configured to control various end devices. For example, valves 26 may open and close tree and manifold gates valves, cause chokes to open and close, lock or unlock connectors, stroke end devices 18 to cause them to connect or break a connection, etc.

Figure 2:
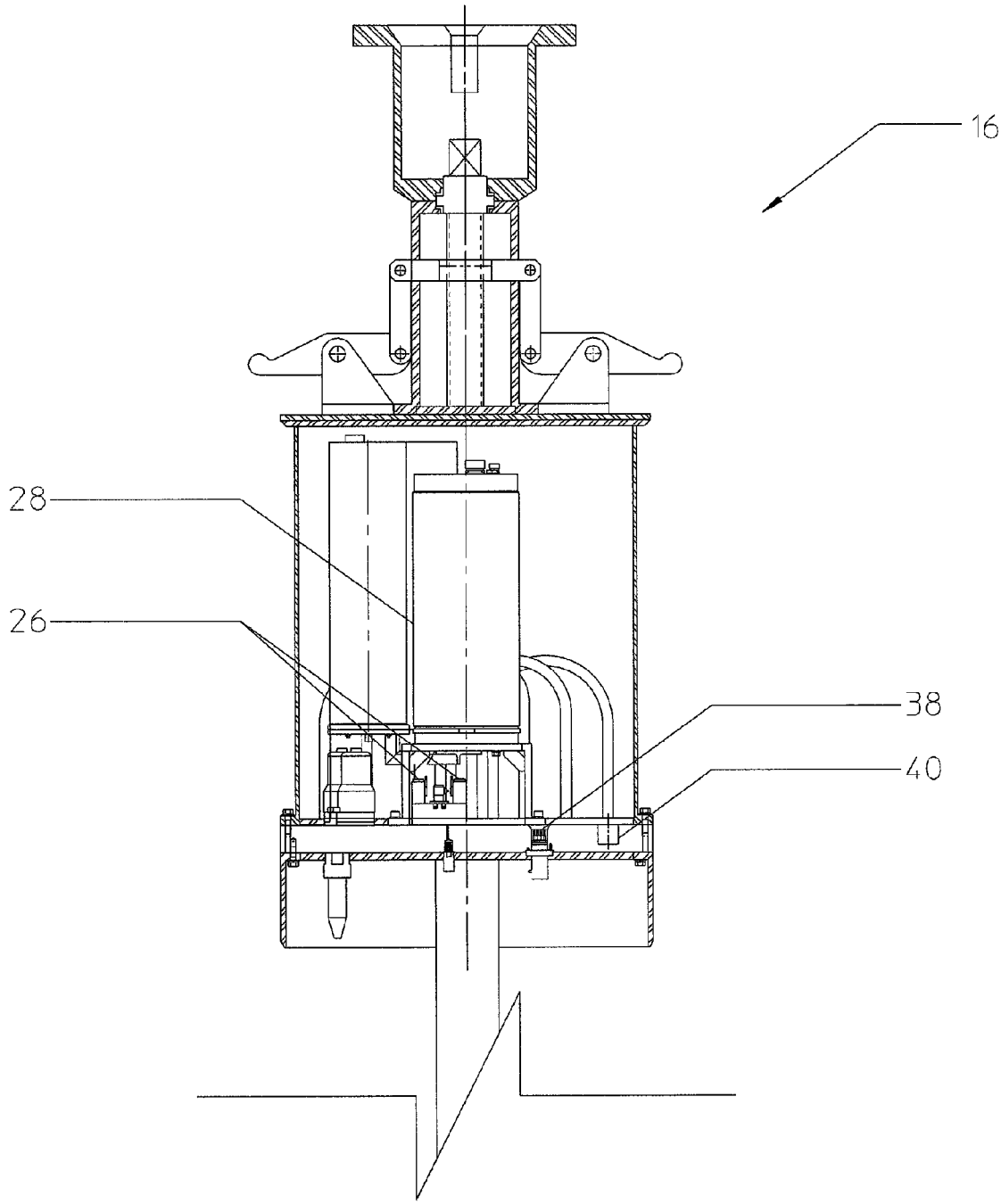
FIG. 2 illustrates a cross-sectional view of an upstream connector of a jumper in accordance with various exemplary embodiments of the present invention.

Downstream connector 16 may be configured to communicate with end device 18, to allow hydraulic pressure to be transmitted to end device 18. Downstream connector 16 may include one or more of electrical connector 38 and hydraulic coupling 40, as shown in FIG. 2. Electrical connector 38 and hydraulic couplings 40 may provide interfaces for hydraulic supplies, electrical power and/or communications signals. In some embodiments, end device 18 may be a Christmas tree as illustrated in FIG. 1. In this example, valves 26 (shown in FIG. 2) may open and/or close causing gate valve 36 to open and/or close, in a similar way a choke on the tree could be opened or closed, downhole vales can be opened and closed, downhole smart valves can be shifted from open to closed position, etc. While end device 18 is illustrated in FIG. 1 as a Christmas tree, other end devices may include pumping units, manifolds, other subsea structures including processing units, or any other type of end device associated with subsea operations.

As indicated above, connectors 12 and 16 may each include a number of functions. For example, subsea electronics modules, processors, modems, electric power supplies, hydraulic connections, hydraulics, valves, pressure sensors, connections, interface to controlled devices, filters, communications, interface to end device, valve input/output boards, sensor interfaces, low pressure functions, high pressure functions, hydraulic couplers, accumulation, electronic cards, and any number of other functions may be included in either, neither, or both of connectors 12 and 16. Similarly, while the disclosure notes functions in both connectors 12 and 16, in alternative embodiments, one of connectors 12 and 16 may include multiple functions while the other of connectors 12 and 16 has no functions.

Jumper 10 of the present disclosure connect to umbilical 14 and/or end device 18 using the methods of U.S. Pat. No. 7,318,479, which is hereby incorporated by reference in its entirety. While connectors 16 and 12 of the present illustrations and of U.S. Pat. No. 7,318,479 are vertical connectors configured to engage respective c-shaped mating sockets vertically, other configurations will be readily apparent to those having ordinary skill in the art. In particular, jumpers have conventionally had parts on their ends that are moveable horizontally into and out of connection with a subsea structure. Such horizontal configurations would be apparent to those having ordinary skill in the art.

In addition to jumper 10 being programmable or "smart," potential advantages of jumper 10 as disclosed herein may also include reduced complexity of the subsea control module and a smaller package that may be cheaper, lighter and/or easier to retrieve. Jumper 10 may have applicability in a broad range of applications and environments, including mudline trees and deep-water devices.

Therefore, the various illustrative embodiments of the present invention enabled and described herein are well adapted to carry out the objects and attain the ends and advantages mentioned, as well as those that are inherent therein. While the present invention has been depicted, described, and defined by reference to exemplary embodiments of the present invention, such a reference does not imply any limitation of the present invention, and no such limitation is to be inferred. The present invention is capable of considerable modification, alteration, and equivalency in form and function as will occur to those of ordinary skill in the pertinent arts having the benefit of this disclosure. The depicted and described illustrative embodiments of the present invention are exemplary only and are not exhaustive of the scope of the present invention. Consequently, the present invention is intended to be limited only by the spirit and scope of the appended claims, giving full cognizance to equivalents in all respects.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Accordingly, the protection sought herein is as set forth in the claims below.

What is claimed is:

1. A jumper comprising:

an upstream connector configured to communicate with an umbilical;

a downstream connector configured to communicate with an end device;

a conduit having a first end attached to the upstream connector and a second end attached to the downstream connector;

a plurality of valves; and a programmable processor, wherein the programmable processor is programmed to at least one of communicate with a remote device, operate hydraulic functions on the end device and monitor a signal from a remote sensor.

2. The jumper of claim 1, wherein the programmable processor is in the upstream connector.

3. The jumper of claim 1, wherein the plurality of valves are in the downstream connector.

4. The jumper of claim 1, wherein the upstream connector comprises an electric power supply.

5. The jumper of claim 1, wherein the upstream connector comprises a modem.

6. The jumper of claim 1, wherein the upstream connector comprises hydraulic functions.

7. The jumper of claim 1, wherein the upstream connector comprises at least one hydraulic filter.

8. The jumper of claim 1, wherein the conduit comprises a hydraulic and electrical bundle.

9. The jumper of claim 1, wherein the conduit comprises a collection of smaller conduits and electrical cables.

10. The jumper of claim 1, wherein the conduit comprises fiber optic wiring.

11. The jumper of claim 1, wherein the upstream connector comprises an electric power supply, a modem, hydraulic functions, and at least one hydraulic filter;

wherein the programmable processor is in the upstream connector;

wherein the programmable processor is programmed to communicate with the remote device, operate hydraulic functions, and monitor signals from remote sensors;

wherein the plurality of valves are in the downstream connector; and wherein the conduit comprises a collection of smaller conduits and electrical cables.

* * * * *